United States Patent [19]

Muraki

[11] 4,247,782

[45] Jan. 27, 1981

[54] X-RAY TUBE UNIT

[75] Inventor: Takeshi Muraki, Yokohama, Japan

[73] Assignee: Tokyo Shibaura Denki Kabushiki Kaisha, Kawasaki, Japan

[21] Appl. No.: 959,367

[22] Filed: Nov. 9, 1978

[30] Foreign Application Priority Data

Nov. 21, 1977 [JP] Japan ..... 52/155356[U]

[51] Int. Cl.[3] ..... H01J 35/16; H01J 35/02

[52] U.S. Cl. ..... 250/523; 313/60

[58] Field of Search ..... 250/421, 523; 313/60

[56] References Cited

U.S. PATENT DOCUMENTS

| | | | |
|---|---|---|---|
| 1,990,368 | 2/1935 | Bouwers | 250/523 X |
| 3,500,097 | 3/1970 | Perry et al. | 313/60 X |

*Primary Examiner*—Robert Segal

*Attorney, Agent, or Firm*—Cushman, Darby & Cushman

[57] ABSTRACT

An X-ray tube unit for neutral-grounded use which comprises an X-ray tube having an envelope with the central portion formed of a metal cylinder, a housing containing the X-ray tube, and a lead wire extending from the cylinder to the outside of the housing, whereby the X-ray tube is electrically insulated from and fixed to the housing, and charged potential in the metal cylinder is dropped.

8 Claims, 5 Drawing Figures

X-RAY TUBE UNIT

BACKGROUND OF THE INVENTION

This invention relates to an X-ray tube unit containing within a housing an X-ray tube which includes a metal cylinder at the central portion of an envelope.

FIG. 1 shows a prior art X-ray tube unit which contains within a housing an X-ray tube with a metal cylinder at the central portion of an envelope. In this drawing, the X-ray tube 1 is screwed to projectons 7 and 8 at fixed positions on the inside wall of the housing 6 by means of supports 4 and 5 attached to an anode bar 2 and a cathode side bulb 3 of the X-ray tube, respectively. Also, a stator 9 for driving the anode of the X-ray tube is screwed to a projection 10 at a fixed position on the inside wall of the housing. The metal cylinder 11 at the central portion of the envelope is fitted with an X-ray emission window 12.

As is generally known, anode- and cathode-side ends 13 and 14 of the X-ray tube, which need be electrically insulated, are made of glass. In X-ray tubes with the central portion of the envelope formed of a metal cylinder, therefore, the metal cylinder at the central portion and the glass portions at the anode and cathode sides are joined together by a known fusion method. Thus, primary electrons from the cathode are accelerated by a high voltage to hit against a target, thereby producing quantities of secondary electrons. Part of these secondary electrons, however, will inevitably plunge into the metal cylinder of the envelope, so that electric charges will be stored gradually in the cylinder. When the charges are stored to a high degree, a potential difference is developed at the junction of the metal cylinder and the glass portions of the envelope. This potential difference brings about discharge at the junction to break the glass portions, thereby rendering the X-ray tube unusable. Moreover, the storage of the charges in the metal cylinder of the envelope will damage the uniformity of the electric field between the anode and the cathode, so that the action of the primary electron current or the X-ray tube current will lose its stability.

Such conventional X-ray tube is provided with no means for eliminating the potential difference which is produced at the junction between the metal cylinder and the glass portions of the envelope. Furthermore, the aforesaid means for attaching the X-ray tube to the housing are subject to some defects, such as too many components, extremely complex assembly, etc.

SUMMARY OF THE INVENTION

The object of this invention is to provide an X-ray tube unit for neutral-grounded use allowing easy mounting of an X-ray tube inside a housing, and capable of electrically insulating a metal cylinder of an envelope of the X-ray tube from the housing, and of taking out electric charges stored in the metal cylinder to the outside of the housing.

DETAILED DESCRIPTION OF THE PREFERRED EMBODIMENT

Figure 1:
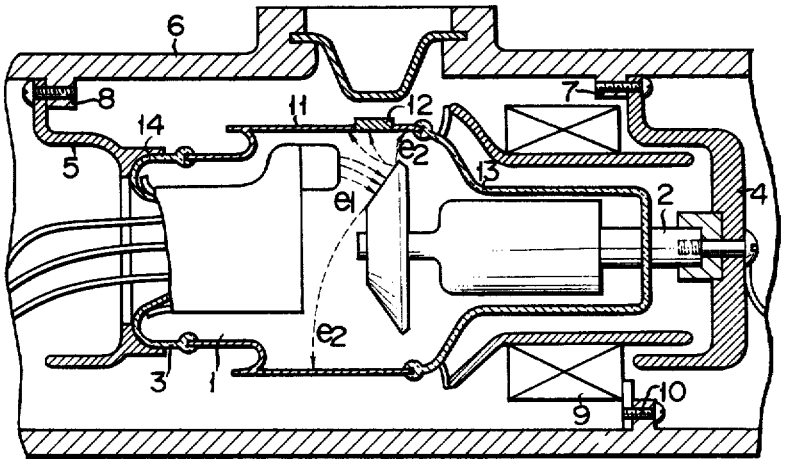
FIG. 1 PRIOR ART
FIG. 1 is a sectional view of the principal part of a prior art X-ray tube unit.
Figure 2:
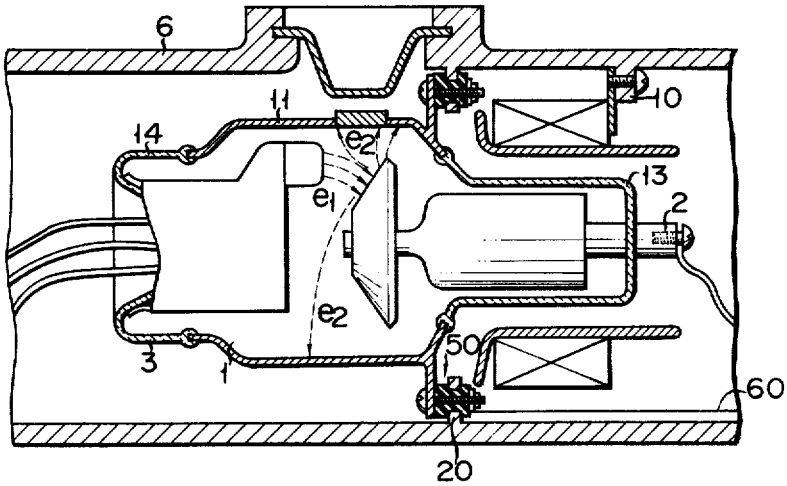
FIG. 2 is a sectional view of the principal part of an embodiment of the X-ray tube unit of this invention.
Figure 3:
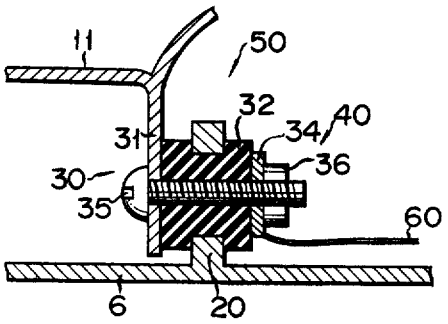
FIG. 3 is an enlarged sectional view of a fixing mechanism of the X-ray tube unit of FIG. 2.

FIG. 2 is a sectional view of the X-ray tube unit according to this invention, in which the construction of the X-ray tube is the same as the prior art construction as shown in FIG. 1 and the individual components are designated by like reference numerals. That is, the central portion of the envelope of the X-ray tube 1 is formed of the metal cylinder 11, while the anode- and cathode-side ends 13 and 14 of the envelope are made of glass. The metal cylinder 11 and the glass portions are fused together, and the metal cylinder is provided with an X-ray emission window 12. Unlike the one shown in FIG. 1, however, the inside wall of the housing 6 to contain the X-ray tube has projections 20 for fixing the X-ray tube 1 at fixed positions facing the metal cylinder 11 of the envelope, as well as the projection 10 for fixing the stator 9 on the anode side. Retainer means 50 are each composed of each of the X-ray tube fixing projections 20 on the inside wall of the housing 6, a fixing member 30 as mentioned later, and a means 40 for fixing the fixing member 30 to each projecton. The fixing member 30, as shown in FIG. 3, is provided with an extending strip 31 outwardly stretching from the metal cylinder 11 of the envelope and an insulator 32 interposed between the extending strip 31 and the projection 20 of the housing. The extending strip is extending from the anode ride of the metal cylinder 11 of the envelope and is fixed to the inside wall of the housing on the anode side of the X-ray tube. Thus, each projection on the inside wall faces the extending strip. Although the extending strip should preferably be located as aforesaid, it may otherwise be disposed on the cathode side of the metal cylinder.

Figure 4:
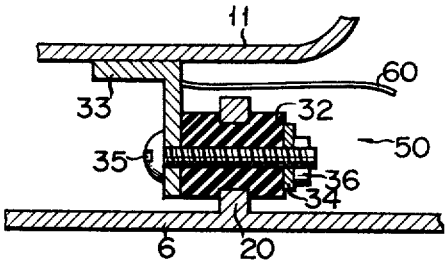
FIG. 4 is an enlarged sectional view of an alternative example of the fixing mechanism of FIG. 3.

Although the extending strip is formed of part of the metal cylinder of the envelope, it may be composed of a metal strip 33 attached to the metal cylinder, as shown in FIG. 4.

The retention of the projection on the inside wall of the housing 6 and the extending strip 31 by means of the insulator 32 is shown in FIG. 3. That is, the insulator 32 is put on the projection 20 of the housing, and the tip end portion of the extending strip is held against one side of the insulator, and screwed thereto by means of a bolt 35 and a nut 36 combined with a ring 34. This method of fixing can be applied to either of the aforesaid two types of extending strips.

The insulator may be made of silicone rubber or Teflon.

Figure 5:
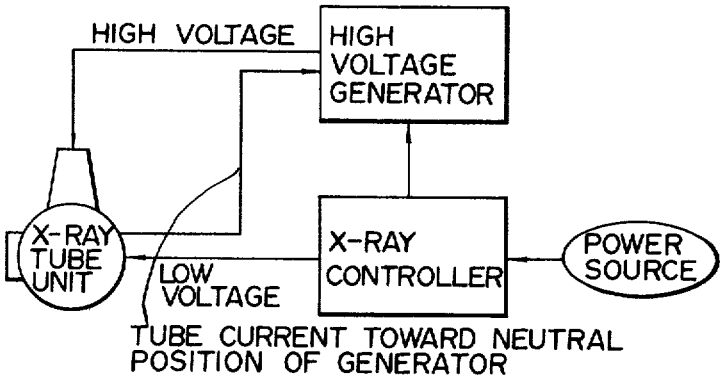
FIG. 5 is a block diagram of an X-ray system incorporating the X-ray tube unit of the invention.

In order electrically to remove the charges stored in the metal cylinder of the envelope, there is provided a lead wire 60 connected to the metal cylinder and extending to the outside of the housing. The other end of the lead wire is connected to the neutral position of a high voltage generator as shown in FIG. 5. Thus, the charges stored in the metal cylinder of the envelope are electrically fed back as a neutral current to the high voltage generator by means of the lead wire. Therefore, the cathode-side current, anode-side current and neutral current can definitely be discriminated from one another at the high voltage generator, so that there may be avoided such wrong operation that the anode-side current is mistaken for the X-ray tube current to overload and break the X-ray tube. Also avoidable is any abnormal discharge between the glass and metal portions of the envelope, since the charges stored in the metal cylinder may be electrically removed.

One end of the lead wire may be connected to the metal strip as shown in FIG. 4, though it is connected to the ring at the screwed portion of the fixing member in FIG. 3.

Thus, according to this invention, the X-ray tube may be fixed to the housing at one portion, in addition to the aforementioned effect, so that the assembly may be facilitated.

Although there has been shown and described the retention of the metal cylinder forming the envelope of the X-ray tube or the third metal strip joined to the metal cylinder, it is to be understood that the prior art method of sustaining the cathodic glass portion or anode bar may be combined, as a supplement, with the method of retention of this invention without departing from the spirit of the invention.

What is claimed is:

1. An X-ray tube unit for neutralgrounded use comprising an X-ray tube having an envelope with the central portion formed of a metal cylinder, a housing containing said X-ray tube, means for electrically insulating said metal cylinder of the envelope from said housing and retaining said metal cylinder is a fixed position in said housing including a projection on the inside wall of said housing, a fixing member composed of an extending strip outwardly extending from said metal cylinder of said envelope and an insulator interposed between said extending strip and said projection of said housing and means for fixing said fixing member to said projection, and a lead wire connected to said cylinder and extending to the outside of said housing for connection to ground said metal cylinder of the envelope outside said housing.

2. An X-ray tube unit according to claim 1, wherein said projection on the inside wall of said housing and said fixing member are fixed to each other at one portion on the anode side of said X-ray tube.

3. An X-ray tube unit according to claim 2, wherein said extending strip forming said fixing member is composed of part of the metallic portion of said envelope.

4. An X-ray tube unit according to claim 2, wherein said extending strip forming said fixing member is composed of a metal strip attached to the metallic portion of said envelope.

5. An X-ray tube unit according to claim 1, wherein said insulator is made of sillicone rubber.

6. An X-ray tube unit according to claim 1, wherein said lead wire is connected to the neutral position of a high voltage generator outside said housing.

7. An X-ray tube unit according to claim 6, wherein said lead wire is connected to said fixing means.

8. An X-ray tube unit according to claim 2 or 6, wherein said lead wire is connected to said metal strip.

* * * * *